United States Patent [19]

Guibas

[11] 4,123,059

[45] Oct. 31, 1978

[54] AIR GUN GAME WITH DIFFERENT SIZED TARGET PIPES

[76] Inventor: Mark Guibas, 28-25 56th Pl., Woodside, N.Y. 11377

[21] Appl. No.: 820,861

[22] Filed: Aug. 1, 1977

[51] Int. Cl.[2] ..... A63B 63/04; F41B 1/00

[52] U.S. Cl. ..... 273/101; 273/105.2; 273/105 R; 273/95 C; 273/DIG. 26

[58] Field of Search ..... 273/95 C, 101, 102 S, 273/102.1 E, 105.2, 119 B

[56] References Cited

U.S. PATENT DOCUMENTS

| | | | |
|---|---|---|---|
| 724,920 | 10/1902 | McKelvey | 273/101 |
| 1,158,250 | 10/1915 | McCarroll | 273/101 |
| 1,539,648 | 5/1925 | Chester et al. | 273/101 |
| 2,572,146 | 10/1951 | Henry | 273/105.2 |
| 3,009,703 | 11/1961 | Jentsch et al. | 273/101 |
| 3,113,776 | 12/1963 | Romei | 273/119 B |
| 3,572,712 | 3/1971 | Vick | 273/105.2 |
| 3,685,828 | 8/1972 | Getgey et al. | 273/95 C |

FOREIGN PATENT DOCUMENTS

| | | | |
|---|---|---|---|
| 190,054 | 2/1907 | Fed. Rep. of Germany | 273/101 |
| 190,850 | 5/1937 | Switzerland | 273/95 |

*Primary Examiner*—Richard C. Pinkham
*Assistant Examiner*—Lawrence E. Anderson
*Attorney, Agent, or Firm*—Richard L. Miller

[57] ABSTRACT

A game device for being played competitively between players, the game including a housing upon legs, a pair of pneumatic guns at one end of the housing for use by the players to discharge balls toward a target area at the opposite end of the housing, the target consisting of several inlets of different mouth size and each being identified with a numerical scoring value, and chutes from the inlets serving to transport scoring balls back to the players' end of the housing for re-use; each scoring ball, during its return, tripping a counting mechanism for visually indicating a score.

3 Claims, 4 Drawing Figures

BLOW-NET
PLAYER NO. 1
FINAL SCORE
PLAYER NO. 2
SCORE
60
80
100
80
60

AIR GUN GAME WITH DIFFERENT SIZED TARGET PIPES

This invention relates generally game devices which are of the type of pin ball machines.

A principal object of the present invention is to provide a game device in which players competitively shoot balls from air guns toward target inlets each of which has a numerical scoring value in order that a winner can be determined.

Another object is to provide a game device in which the target inlets may be made movable in position in order to make striking a target inlet more difficult.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 3 is an enlarged fragmentary cross section on line 3—3 of FIG. 2 and illustrating a mechanism that intermittently sidewardly slides the targets at varied speeds so to further tax a player's skill.

Figures 1, 2, 4, 5:
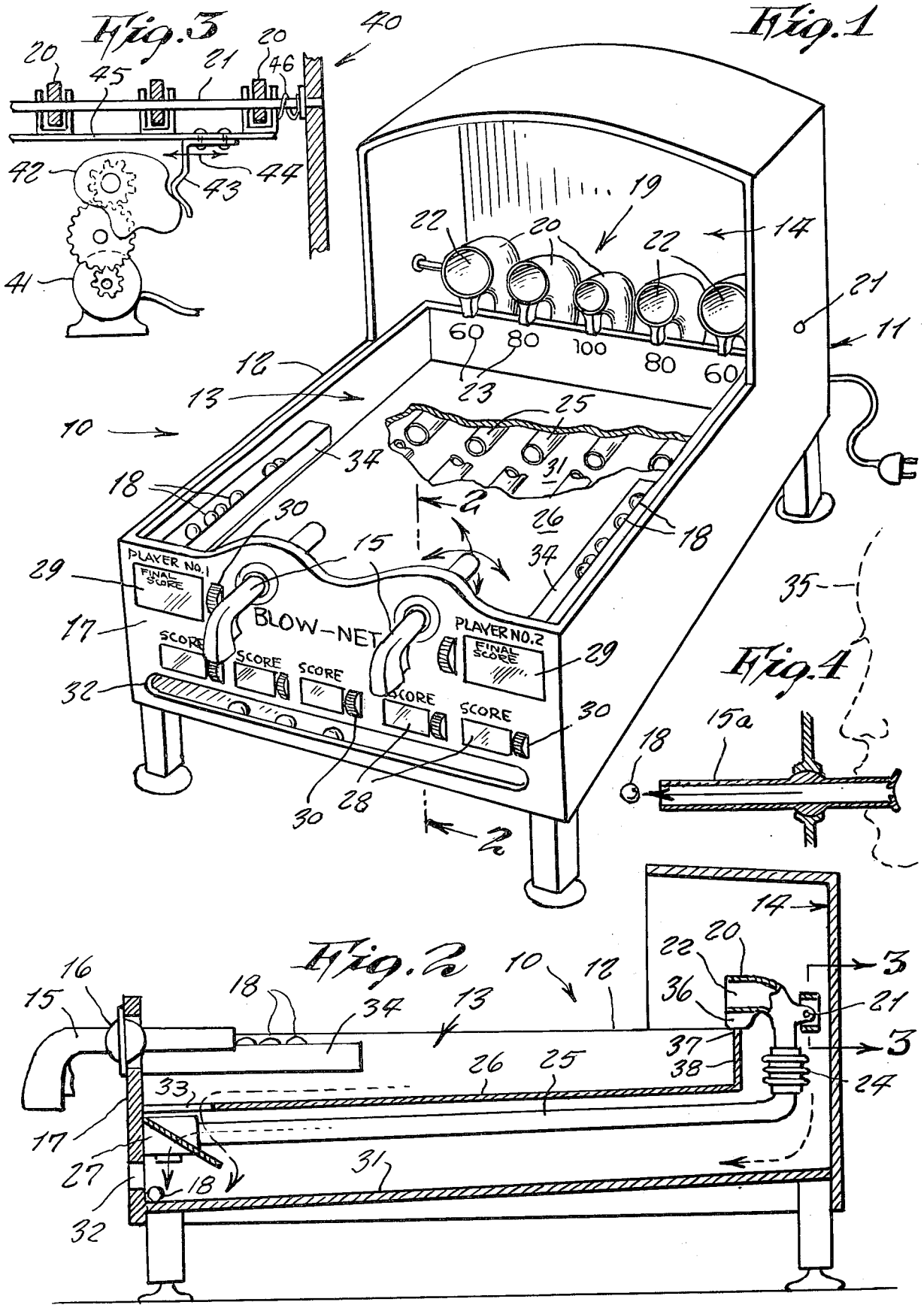
FIG. 1 is a perspective view of the invention.
FIG. 2 is a cross section of line 2—2 of FIG. 1.
FIG. 4 illustrates a modified design of air propulsion for the ball.

Referring now to the drawing in detail, the reference numeral 10 represents a BLOW-NET (GAME) device according to the present invention wherein there is a housing 11 of box-like shape which has a horizontally long opening 12 at one upper end in order to allow view thereinto. The housing thus includes a horizontal tray 13 and a vertical backstop 14. A pair of air-operated pistols 15 are mounted pivotally free by means of universal joints 16 in a front wall 17 of the tray so to discharge balls 18 toward a target area 19 directly in front of the backstop and entering several elbow pipes 20 mounted pivotally free on a single transverse rods 21. The pipes have variously sized mouth inlets 22 and each pipe is indicated by a numerical score value 23 according to the relative size of the inlet, so that a player successfully shooting a ball into any of the inlets can build up a score in playing a competitive game.

An outlet end of the pipes 20 are connected to flexible rubber, corrugated sleeves 24 which are connected to pipes 25 underneath a floor 26 of the tray, the pipes extending in a forwardly-downwardly inclined position in order that balls entering the inlets 22 can be returned back to the player so to be re-used. During return of a ball, it trips a counting mechanism 27 that visually views a score number in a window 28 on the front wall 17. An additional window 29 for each player is located also on the front wall for displaying a final score in a game, and which are provided from a counter that can be either manually operated for determining a final score or which is electrically connected to counters 27, as preferred by a manufacturer. A manually-operated re-set knob 30 is located alongside each window 28 and 29.

Balls that fail to enter a pipe inlet 22, fall either upon the floor 26 or else upon a bottom wall 31 of the housing which likewise are downwardly forwardly inclined so that all balls, whether scoring or not, are returned to a forward end of the housing and all come to just behind an opening 32 in the front wall from where they may be picked up by a player for re-use. An opening 33 at a forward edge of floor 26 allows the balls that roll on the floor to drop on a baffle and then upon the bottom wall, so that all balls are returned to a place behind the opening 32.

A ball rack 34 along each side of the tray serves so that a same number of balls for each player is placed therein when the balls are retrieved from the opening 32.

As shown in FIGS. 1 and 2, the housing is mounted upon legs so to be at a comfortable height to the players.

As shown in FIG. 3, a blow gun 15*a* powered by breath from a player 35 can be used instead of a hand-operated pistol.

In operative use, when a ball strikes inside the inlet of a pipe 20, the pipe may pivot slightly on the rod 21, so a foot 36 of the pipe is thus lifted off an upper edge 37 of a tray end wall 38, and the sleeve flexes accordingly.

In FIG. 3 the pipes 20 are shown to additionally be sidewardly movable so to be more difficult for a ball to strike in the pipe inlet. In this design 40, an electric motor 41 rotates a cam 42 so to cause cam follower 43 to slide various length of distances in either direction (as indicated by double-headed arrow 44) during each rotation of the cam, so that a forked frame 45, secured to the follower, slides the pipes accordingly. A compression spring 46 keeps cam follower and forked frame biased in a direction so that cam follower 43 stays in contact with cam 42.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A game device, comprising in combination, a housing on legs including a horizontal tray and a backstop, a pair of air-powered guns pivoted on a front wall of said tray, a plurality of elbow-shaped pipes pivoted in a row on a transverse rod in front of said back stop, each said pipe having an inlet, said inlets being of various sizes, each said pipe being numerically indicated with a scoring value according to a size of said inlet thereof, and a plurality of balls discharged from said guns toward said inlets; each said elbow pipe being connected by a flexible rubber sleeve to a second pipe extending forwardly downwardly inclined through a counting mechanism and to a ball rest area adjacent to a ball-retrieving opening on said tray front wall.

2. The combination as set forth in claim 1 wherein each said elbow pipe is additionally retained between prongs of a forked frame integral with a cam follower engaging a motor driven cam, said frame and said elbow pipes being sidewardly slidable on said rod.

3. The combination as set forth in claim 2 wherein said counting mechanisms for each said second pipe includes a score displaying window on said tray front wall.

* * * * *